US007909198B2

(12) United States Patent
Lewis

(10) Patent No.: US 7,909,198 B2
(45) Date of Patent: Mar. 22, 2011

(54) TAMPER EVIDENT ENCLOSURE FOR THE STORAGE AND TRANSPORT OF BANK NOTES

(75) Inventor: Robert Anthony Wilbert Lewis, Rearsby (GB)

(73) Assignee: Volumatic Limited (GB)

( * ) Notice: Subject to any disclaimer, the term of this patent is extended or adjusted under 35 U.S.C. 154(b) by 909 days.

(21) Appl. No.: 11/281,329

(22) Filed: Nov. 17, 2005

(65) Prior Publication Data

US 2006/0071412 A1 Apr. 6, 2006

Related U.S. Application Data

(63) Continuation-in-part of application No. 10/362,900, filed as application No. PCT/GB01/03831 on Aug. 28, 2001, now Pat. No. 7,059,599.

(30) Foreign Application Priority Data

Aug. 29, 2000 (GB) ..... 0021014.6
Aug. 29, 2000 (GB) ..... 0021016.1

(51) Int. Cl.
*B65D 43/20* (2006.01)
*B65D 43/22* (2006.01)
*B65D 21/02* (2006.01)

(52) U.S. Cl. ..... 220/345.2; 220/9.1; 220/23.83; 220/326

(58) Field of Classification Search .... 220/345.1–345.4, 220/349, 9.1, 265, 266, 23.83, 326
See application file for complete search history.

(56) References Cited

U.S. PATENT DOCUMENTS

| | | | | | |
|---|---|---|---|---|---|
| 2,472,582 | A | * | 6/1949 | Green | 220/315 |
| 3,655,186 | A | | 4/1972 | Bayha | |
| 4,120,400 | A | * | 10/1978 | Kotyuk | 206/528 |
| 4,790,476 | A | | 12/1988 | Tanaka et al. | |
| 4,819,829 | A | * | 4/1989 | Rosten et al. | 220/345.3 |
| 4,946,057 | A | * | 8/1990 | Connolly et al. | 220/481 |
| 5,161,736 | A | | 11/1992 | Roccoberton et al. | |
| 5,176,315 | A | | 1/1993 | Homel | |
| 5,285,918 | A | * | 2/1994 | Weisburn et al. | 220/265 |
| 5,328,049 | A | * | 7/1994 | Ritzow | 220/315 |
| 5,400,914 | A | * | 3/1995 | Lin | 220/345.4 |

(Continued)

FOREIGN PATENT DOCUMENTS

EP 0 124 729 11/1984

(Continued)

*Primary Examiner* — Anthony Stashick
*Assistant Examiner* — Niki M Eloshway
(74) *Attorney, Agent, or Firm* — Akerman Senterfitt; Peter A. Chiabotti

(57) ABSTRACT

A tamper-evident enclosure for the storage and transport of bank notes comprises a frame spanned by a membrane of elasticated material. The frame is located in the top of an open-topped container and bank notes are pushed through the frame, deflecting flaps, until the membrane is fully distended. A cover plate is then slid through channels on opposite sides of the frame to close the "bag". When the "bag" is fully closed a tongue at the leading end of the cover plate enters a hollow formation at the trailing end of the frame. Either the tongue has fins which dig into the interior of the hollow formation, or the channels and opposite sides of the cover plate have saw-tooth formations permitting movement of the cover plate only in one direction. By either arrangement the cover plate can only be removed from the frame by first breaking off the tongue and bending down the hollow formation.

21 Claims, 7 Drawing Sheets

U.S. PATENT DOCUMENTS

| | | | | |
|---|---|---|---|---|
| 5,533,605 | A | 7/1996 | Mays et al. | |
| 5,595,129 | A | 1/1997 | Grobe | |
| 5,607,102 | A | 3/1997 | Walsh et al. | |
| 5,611,483 | A | 3/1997 | Sciortino | |
| 5,653,436 | A | 8/1997 | Zouzoulas | |
| 5,715,923 | A | 2/1998 | Dekker et al. | |
| 5,788,105 | A * | 8/1998 | Foos | 220/266 |
| 5,788,109 | A * | 8/1998 | Borghini | 220/345.3 |
| 5,850,966 | A | 12/1998 | Siler et al. | |
| 5,890,439 | A | 4/1999 | McGunn | |
| 6,024,531 | A | 2/2000 | Schulze | |
| 6,112,934 | A * | 9/2000 | Jung et al. | 220/315 |
| 6,210,638 | B1 * | 4/2001 | Grieco et al. | 422/22 |
| 6,328,355 | B1 * | 12/2001 | Bortz | 292/307 R |
| 6,814,225 | B2 * | 11/2004 | Belden et al. | 206/1.5 |
| 6,877,631 | B1 * | 4/2005 | Thompson et al. | 220/266 |
| 7,114,619 | B2 * | 10/2006 | Ellis et al. | 206/540 |
| 7,198,149 | B2 * | 4/2007 | Gelardi | 206/1.5 |
| 2004/0050849 | A1 * | 3/2004 | Pickles | 220/324 |
| 2005/0023238 | A1 * | 2/2005 | Wong | 215/252 |
| 2005/0029260 | A1 * | 2/2005 | Sheng-Bin | 220/9.1 |

FOREIGN PATENT DOCUMENTS

| | | |
|---|---|---|
| EP | 0662675 | 7/1995 |
| EP | 0 674 296 | 9/1995 |
| EP | 0852279 | 8/1998 |
| FR | 2836675 | 9/2003 |
| GB | 2 199 890 | 7/1988 |
| GB | 2 213 870 | 8/1989 |
| GB | 2 236 143 | 3/1991 |
| GB | 2 313 622 | 12/1997 |

* cited by examiner

201

118
114B
21A
114
107
22A
A
116
117
115

111

200

114A

Fig 6
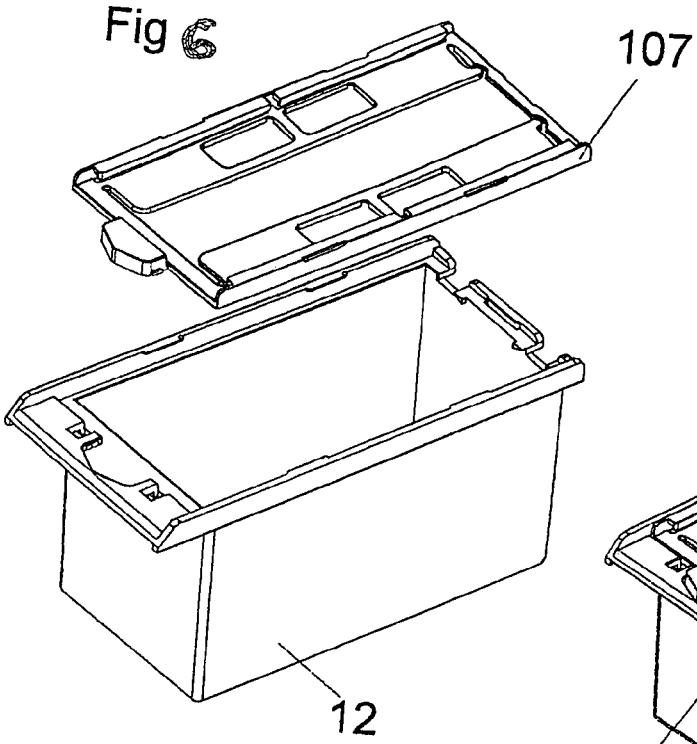
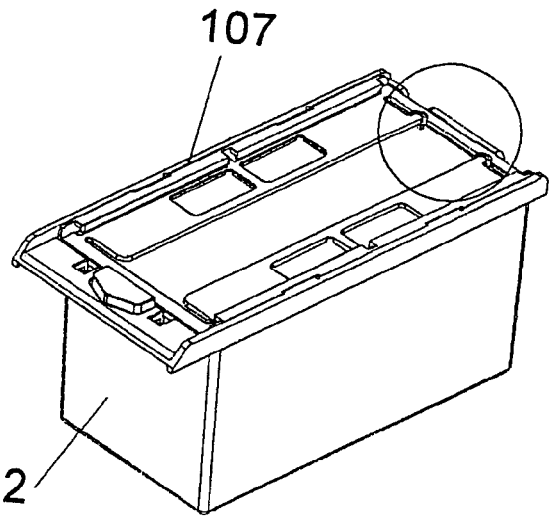
Fig 7
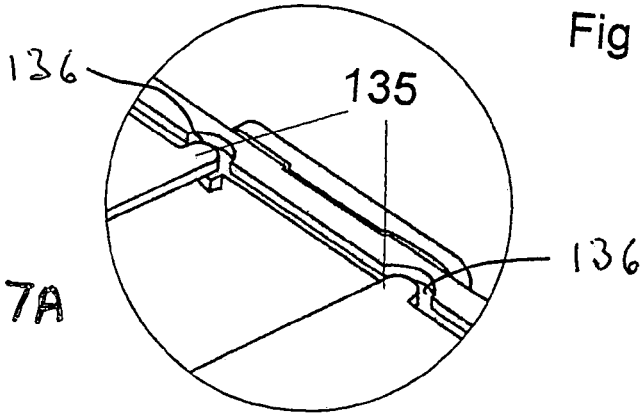
Fig 7A
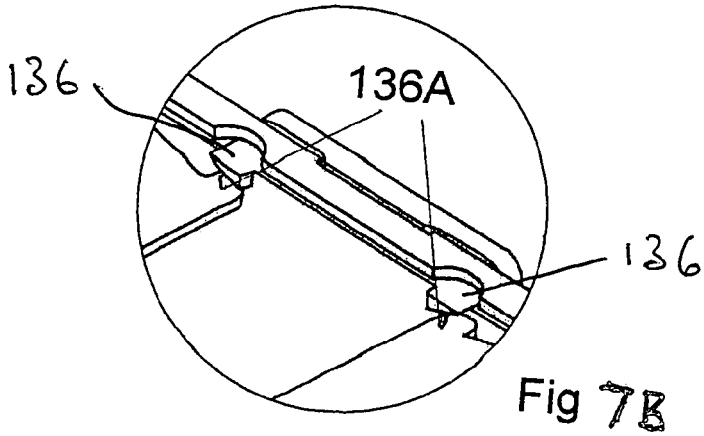
Fig 7B

Fig 8
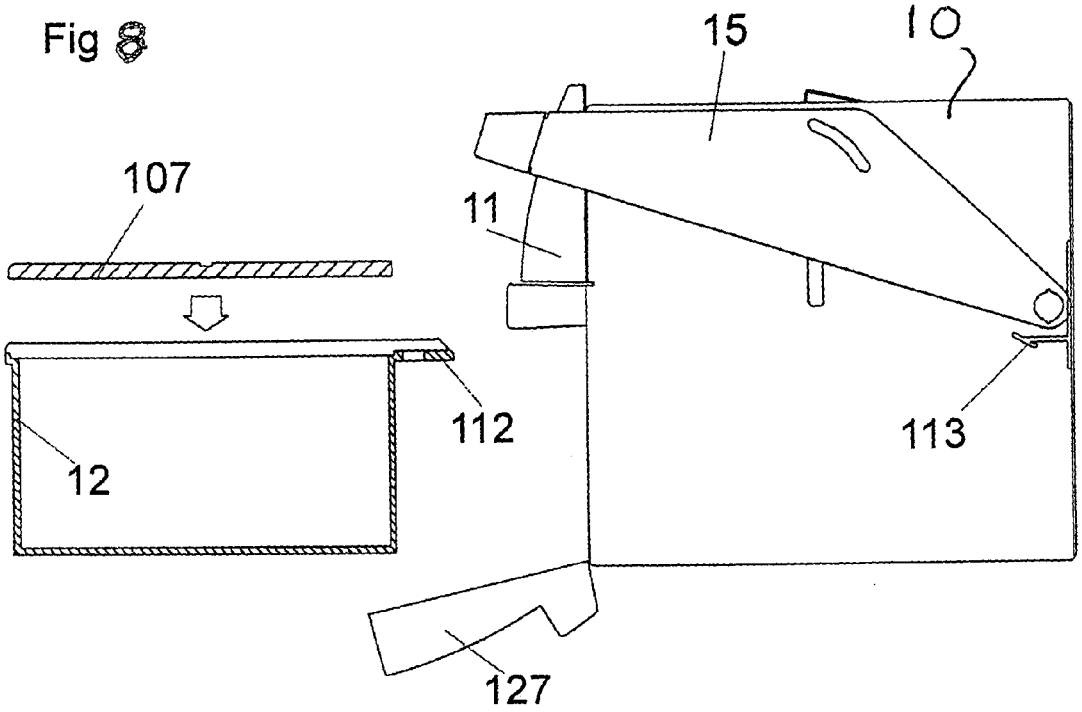
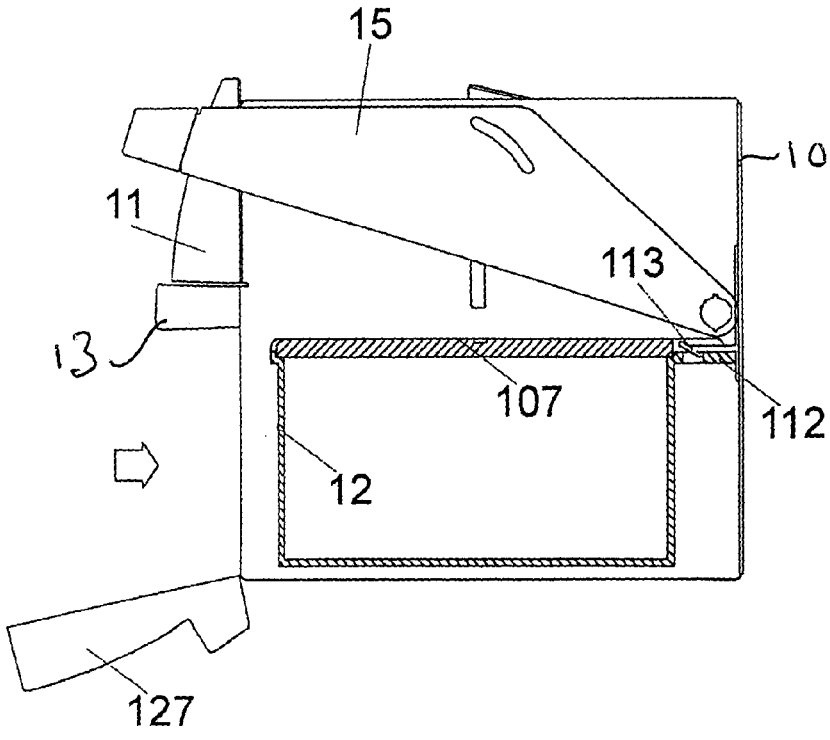
Fig 9

TAMPER EVIDENT ENCLOSURE FOR THE STORAGE AND TRANSPORT OF BANK NOTES

CROSS-REFERENCE TO RELATED APPLICATION

This application is a continuation-in-part of U.S. patent application Ser. No. 10/362,900 filed Feb. 25, 2003, which was a §371 National Phase application of PCT/GB01/03831, filed Aug. 28, 2001, and the entirety of both applications is herein incorporated by reference.

This invention relates to a tamper-evident enclosure for the storage and transport of bank notes.

Typically, at a point of sale such as a cashier's desk in a supermarket, a container is suspended beneath the desk for the intermittent reception of wads of bank notes. It may be used to store notes as they are taken from customers, but more usually it acts as an "overflow" for the till on top of the desk. When the pile of notes of a particular denomination in the till reaches a given level it is transferred to the container, which offers better security than the till. Periodically the loaded containers are taken by security personnel to a bank, or more usually they are taken by the staff to a central counting room, where the money is counted and bagged for transport to the bank.

Containers currently in use are rigid boxes which slide into and out of guides beneath a counter whereby they are supported. Provision is normally made for locking them in position. The front face of a container is upwardly inclined and has an exposed top opening through which a wad of notes can be inserted. Behind the inclined front face is a barrier with a central, vertical slot. A plunger mechanism hinged near the bottom of the barrier can be manipulated, when notes have been inserted, to push them through the slot into the body of the container.

Containers of this kind have numerous drawbacks. They are expensive to produce and are not adequately tamper proof. Money behind the slotted barrier is still accessible through the opening and can be "fished" using, for example, adhesive tape. The relatively clumsy plunger mechanism can trap fingers and damage nails.

An object of one aspect of the present invention is to improve upon current arrangements and to provide a more tamper-proof apparatus which is nevertheless easy to use with less danger of injury.

Security firms are reluctant to handle the rigid containers and require the money to be taken out of them and bagged before they will transport it to the bank. This places considerable demands on the staff of the counting room, which is not justified by any real need that the money should be manually counted before it is taken away. Even if a security firm can be persuaded to take the containers they present transport and storage problems because of their bulk and rigidity, and as they are too expensive to be disposable there is the additional problem of their return.

The present invention proceeds from the recognition that it is an unnecessary expense to employ a rigid container. No container, however strong, will withstand a determined attempt to breach it. All that is in practice necessary is to be able to determine immediately and with certainty that a breach has occurred so that the culprit can be identified.

In accordance with the present invention there is provided a tamper-evident enclosure for the storage and transport of bank notes, the enclosure comprising a frame spanned by a flexible material, the frame having parallel sides provided with flanges under which side edges of a cover plate may be received, whereby the cover plate can be slid under the flanges to close the frame, a leading end of the cover plate being provided with a tongue which enters a correspondingly shaped, hollow formation at the leading end of the frame as the cover plate fully closes the frame and latch means to prevent withdrawal of the tongue from said hollow formation once received therein.

The tongue may be breakable and said hollow formation can be bent down and the arrangement may be such that the cover plate can be removed by continued movement in the same direction once the tongue is broken and bent down with the hollow formation.

Said latch means may comprise rearwardly and outwardly extending fins on the lateral edges of the tongue which will be deflected as the tongue enters said hollow formation to prevent withdrawal of the tongue therefrom. The hollow formation is preferably of a material soft enough to be bitten into by the fins if an attempt is made to withdraw the tongue from the hollow formation.

Alternatively the latch means may comprise opposite saw-tooth formations on the frame and on the cover plate which, when mutually engaged, ensure that the cover plate can be slid relative to the frame only in one direction. Said saw-tooth formations are preferably under the flanges of the frame and on said side edges of the cover plate.

Said flexible material may be an elasticated material.

The frame may be adapted to be snap-fitted into the top of an open-topped container which is locatable in a housing, the container being held in the housing by a catch which is disengaged by the cover plate as the latter fully closes the frame.

There may be hinged to parallel sides of the frame flaps biased to remain in a co-planar attitude, stop means being provided to prevent said flaps rising above the frame, said flaps being deflectable to allow passage of one or more bank notes to be bagged in the flexible material.

End edges of the flaps may have protrusions which are forced past the adjacent end member of the frame as one or more bank notes are pushed through the frame, the protrusions engaging the underside of said end member to prevent the flaps rising from the frame when the pushing force is relieved.

Preferred embodiments of the present invention will now be described by way of non-limitative example with reference to the accompanying drawings, in which:

FIGS. 6-7B illustrate how the bag frame is seated in its container, FIGS. 7A and 7B showing on a larger scale how a detail of the bag frame works;

Figure 13:
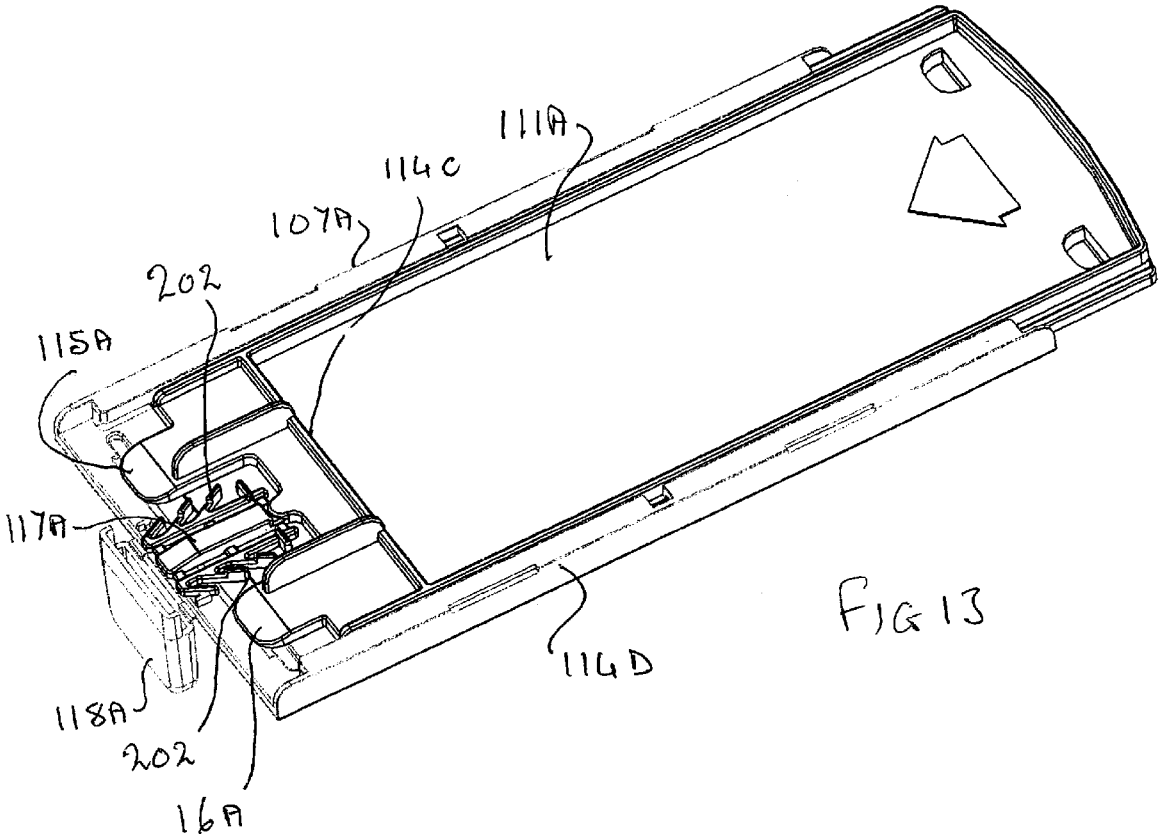

FIGS. 8-12 illustrate the insertion of a closure plate to seal a full bag, simultaneously releasing the container so that it can be withdrawn, the positioning of a new frame in the container and its re-insertion into the housing, and FIG. 13 illustrates a modification in which saw-tooth formations in the channels and on side edges of the frame are dispensed with, but the tongue has fins which will prevent its withdrawal from the hollow formation of the frame after insertion.

The tamper-evident enclosure for the storage and transport of bank notes of the present invention is intended primarily, but not exclusively, for use in connection with the apparatus disclosed in our co-pending U.S. patent application Ser. No. 10/362,900 proceeding from International Patent Application No. PCT/GB01/03831 published as WO 02/019289. Reference is made to that publication for a clearer understanding of the present invention. Briefly, bank notes are placed in a tray 13 which is then slid through a slot into a box like housing 10 (see FIGS. 8 and 9). A lever 15 is then operated to cause a plunger to move the banknotes through the openable bottom of the tray into a storage facility 12. When this is full it can be removed through a lockable door in the front face of the housing 10.

In accordance with the present invention the container 12 (FIGS. 6 and 7) has snap-fitted into its open top a frame 107 across the underside of which is stretched a piece 108 of elasticated material. The frame 107 has hinged lateral flaps 21A,22A which do not extend fully across the frame 107. After deflection downward into the carrier 12 by the plunger the flaps 21A,22A will tend to resume the co-planar attitude under the influence of the elasticated material 108.

Figure 3:
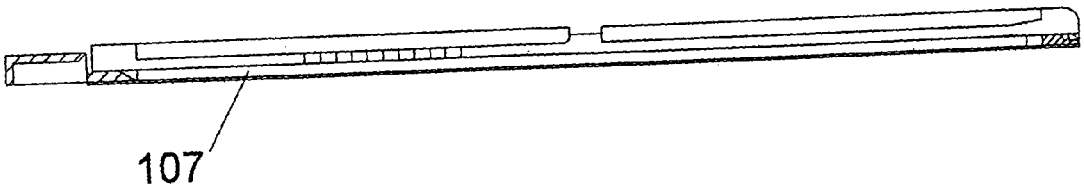
FIGS. 1-3 are respectively an underside view, a top view and a side elevation of the disposable bag and its frame.
Figure 1:
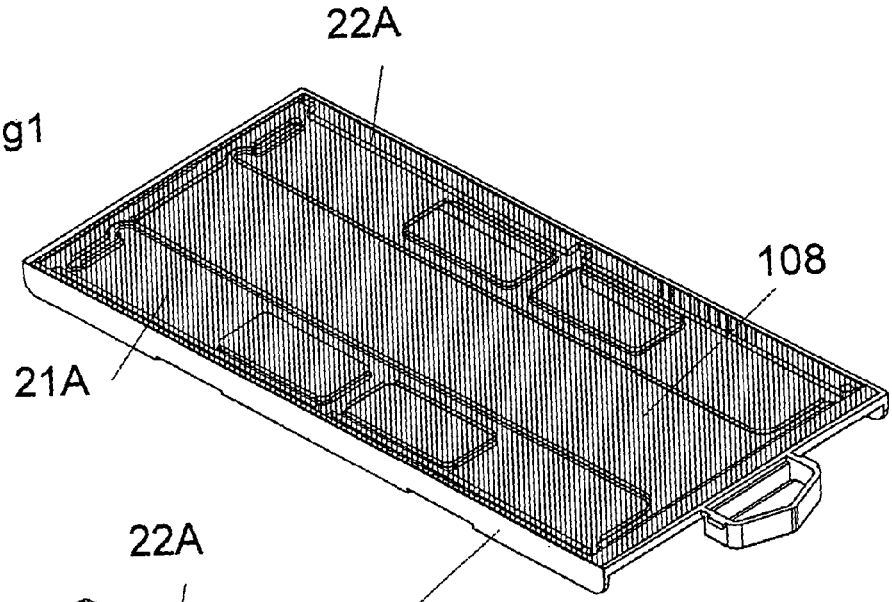
Figure 2:
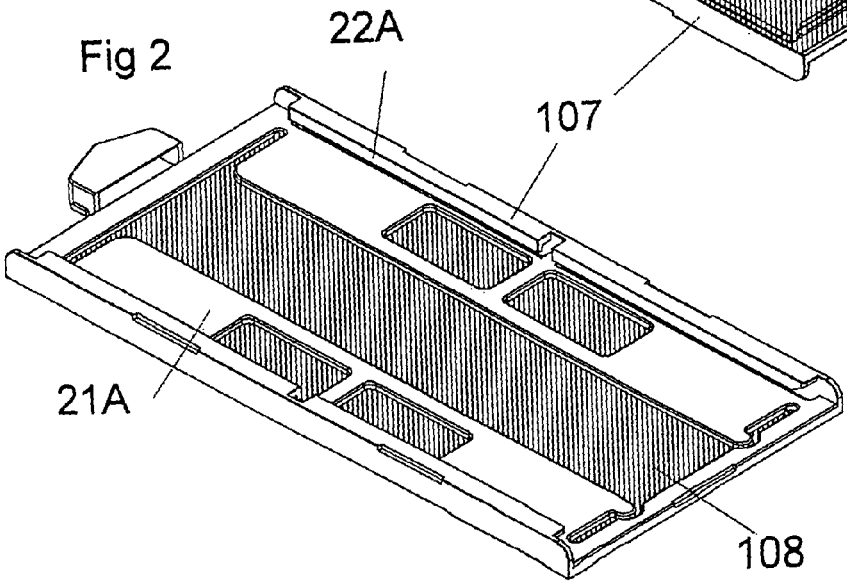

When the lever 15 is depressed (FIGS. 3 and 4) the plunger presses down on any note or notes in the tray, causing the flaps of the tray, as well as the flaps 21A and 22A, to deflect downwards. Once the note has passed the flaps 21A,22A it will spread out so as to be caught behind the flaps 21A,22B of the frame 107. When the lever 15 is now raised again the flaps 21A,22A spring back to the co-planar attitude as they cease to be deflected by the rising plunger 17. The cycle can now be repeated until the distended "bag" 108 can accept no more notes.

Figure 11:
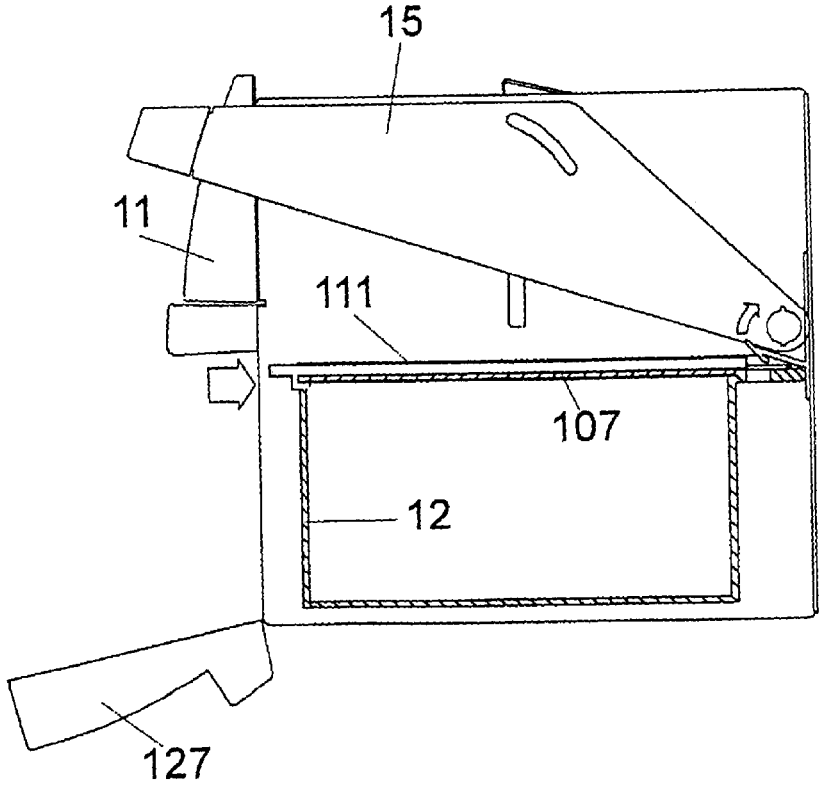
Figure 12:
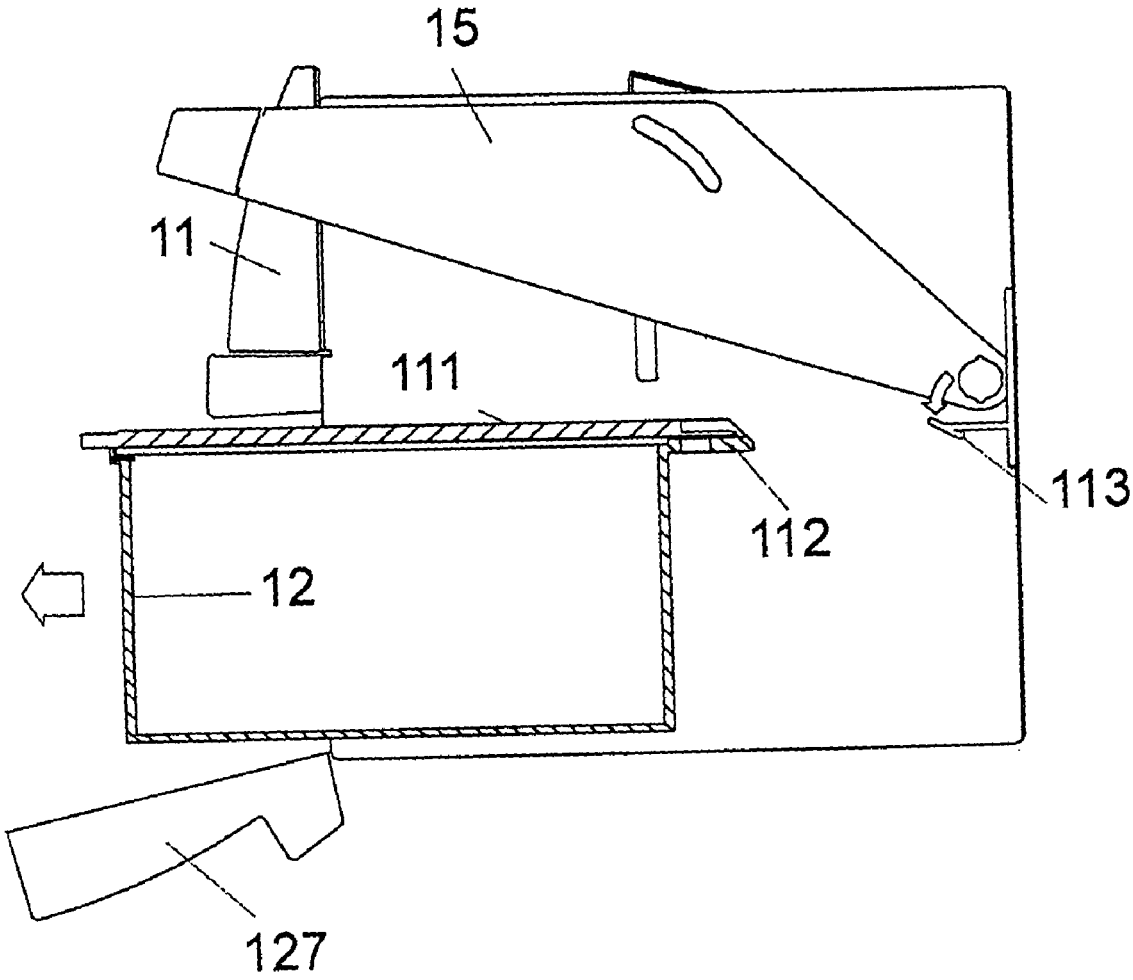

To remove the full bag 108 from the housing 10 its door is opened. At this point however the container 12 on which the frame 107 is mounted cannot be pulled out of the housing. When the container 12 was pushed into the housing projections 112 at the back of the container first lifted and then engaged with respective catches 113 at the back of the housing (FIGS. 8 and 9). To enable removal of the container 12 from the housing first a closure plate 111 must be slid under L-shaped flanges 114 and 114B along the sides of the frame 107 until chamfered projections 115 and 116 at the leading end of the closure plate 111 lift the catches 113 out of the openings of the projections 112 (FIG. 11). The container 12 can now be removed from the enclosure (FIG. 12), after which the frame 107, together with the bag 108 and the cover plate 111, is removed from the carrier 12. A new frame 107 with stretched material 108 can now be snap fitted into the top of the container 12 (FIG. 8) and as the latter is slid back into the housing the openings in its projections 112 re-engage the catches 113.

By this arrangement the frame 107 must be sealed by a cover plate 111 before it can be removed from the housing. With the door open and before inserting a cover plate 111 there is insufficient space above the container 12 to enable notes to be "fished" out of the bag 108. The notes are in any event in compression between the material 108 and the undersides of the flaps 21A,22A of the frame 107.

After removal from the container 12 the notes within the "bag" 108 are fully sealed by the cover plate 111 which closes the frame 107. Hooks 114A at the back of the cover plate 111 extend over the rear edge of the bag 108 and will have to be broken if the latter is pulled away from the frame 107 to gain access to the notes within the bag.

Figures 4, 4A, 5, 5A, 5B:
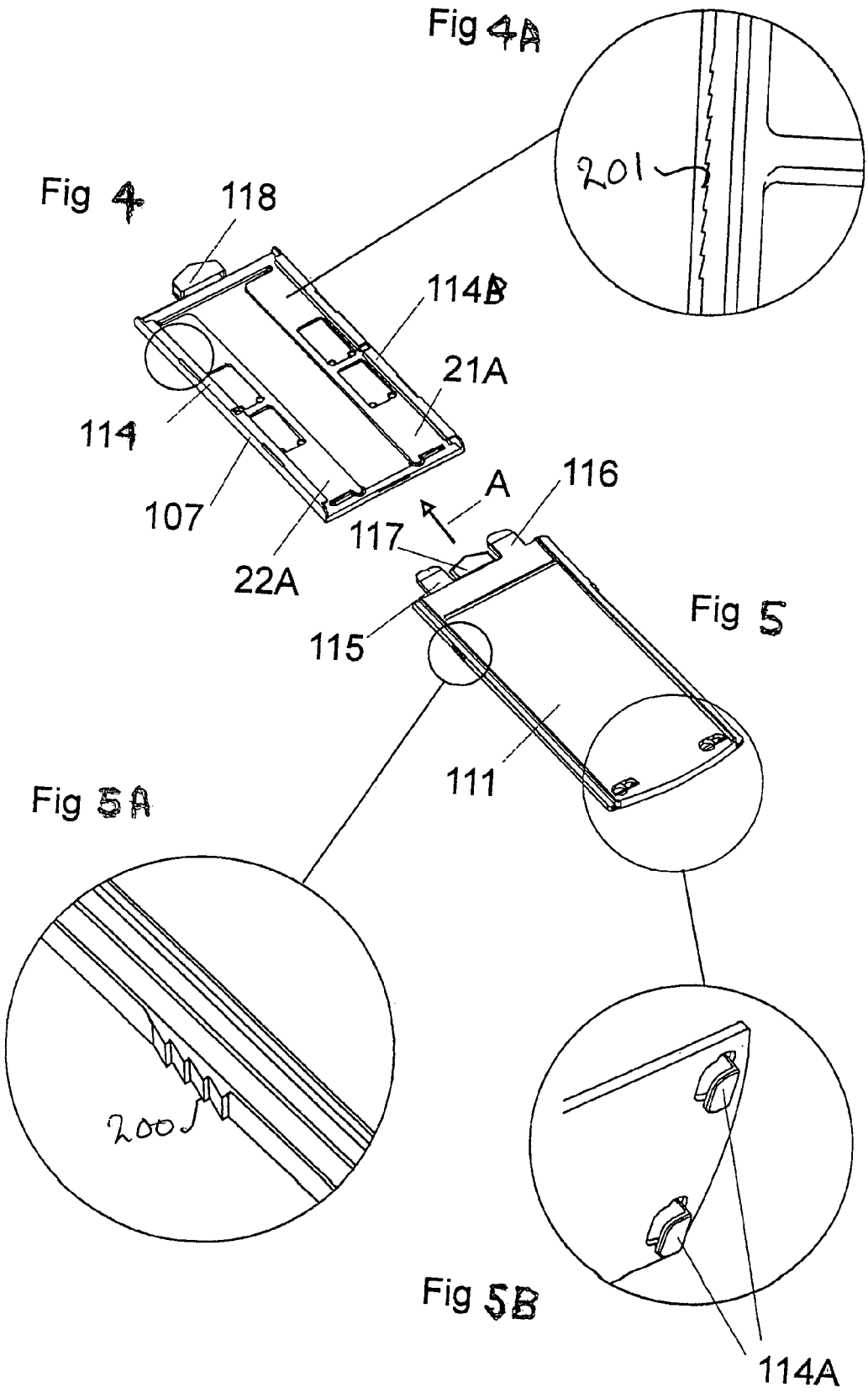
FIGS. 4-5B illustrate the cooperation between the bag frame and a closure plate.
Figure 10:
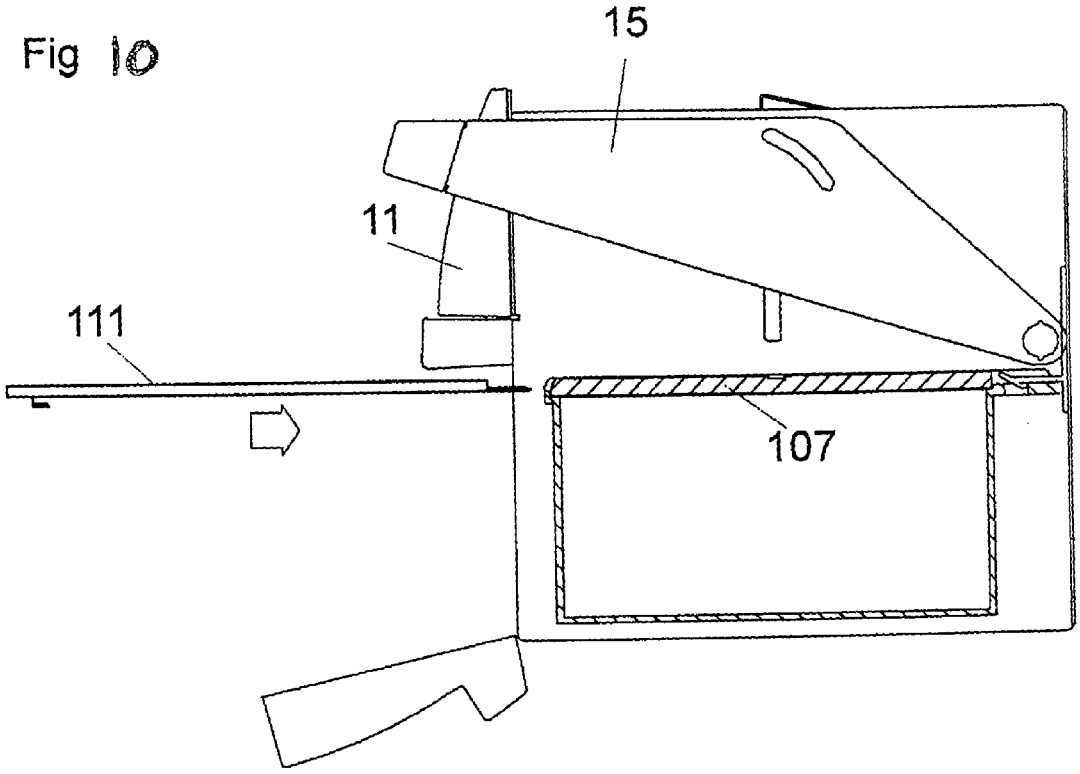

As shown in FIGS. 4 and 5 the sides of the cover plate 111 and the interiors of the channels formed by the flanges 113 and 114 of the frame 107 have reverse saw-teeth formations 200 and 201 such that the cover plate 111 can only move relative to the frame 107 in the direction indicated by the arrow "A" in FIG. 5. As the cover plate 111 slides into its final position closing the frame 107, and lifting the catches 113 by means of the projections 115,116, a tongue 117 at the leading end of the cover plate 111 enters a correspondingly shaped, hollow formation 118 at the leading end of the frame 107. Therefore the cover plate 111 cannot be removed from the frame 107, by further movement in the direction of arrow A, until the tongue 117 has been snapped off, the formation 118 being flexible and bending down to allow passage of the cover plate. Meanwhile if any of these tamper-proofing items 114A, 117,118 have been damaged there will be visible evidence that an attempt has been made to remove money from the bag 108. Damage to the bag 108 itself would of course also be indicative of theft.

FIGS. 7-7B illustrate a feature of the flaps 21A,22A of the frame 107. Each flap has at one of its end edges at a position spaced from the hinged side of the flap a rounded protrusion 135 which normally rests in a recess 136 in the adjacent end member of the frame 107. The first time the plunger depresses the flaps 21A,22A the protrusions 135 pass below the recesses 136. When the plunger 17 is retracted and the flaps 22A,22B are moved back toward the horizontal by the elasticity of the bag 108 they are stopped by the protrusions 135 encountering the chamfered undersides 136A of the recesses 136. Thus there is no possibility that the flaps 22A,22B will rise above the horizontal, which could prevent the subsequent insertion of the closure plate 111 into the channels on either side of the frame 107.

In the modification illustrated in FIG. 13 the saw-tooth formations 200 and 201 are dispensed with. Until the tongue 117A enters the hollow formation 118A the closure plate 111A can be slid under the flanges 114C and 114D in both directions, but as the tongue 117A enters the hollow formation 118A rearwardly and outwardly extending fins 202 on opposite lateral edges of the tongue 117A are deflected and will dig into the interior surface of the hollow formation 118A if an attempt is made to pull back the closure plate 111A contrary to the closing direction of the arrow A'. The fins 202 are flexible and preferably have sharp distal end edges. The material from which the hollow formation 118A is fabricated is preferably soft enough to be dug into by the fins 202. With the tongue 117A inside the hollow formation 118A, therefore, it is not possible to withdraw the closure plate 111A contrary to the arrow A'. To remove the closure plate 111A it is necessary to bend down the hollow formation to the position illustrated in FIG. 13, breaking off the tongue 117A in the process.

The invention claimed is:

1. A tamper-evident enclosure for the storage and transport of bank notes, the enclosure comprising a frame spanned by a flexible material, the frame having parallel sides provided with flanges under which side edges of a cover plate may be received, whereby the cover plate can be slid under the flanges to close the frame, a leading end of the cover plate being provided with a tongue which enters a correspondingly shaped, hollow formation at the leading end of the frame as the cover plate fully closes the frame and latch means to form an irreversible lock between the tongue and said hollow formation once received therein, wherein the enclosure is adapted to be received in a container so as to be removable from the container only when the tongue has formed the irreversible lock with the hollow formation.

2. The enclosure as claimed in claim 1, wherein the tongue is breakable and said hollow formation can be bent down and wherein the arrangement is such that the cover plate can be removed by continued movement in the same direction once the tongue is broken and bent down with the hollow formation.

3. The enclosure as claimed in claim 1, wherein said latch means comprises rearwardly and outwardly extending fins on the lateral edges of the tongue which will be deflected as the tongue enters said hollow formation to prevent withdrawal of the tongue therefrom.

4. The enclosure as claimed in claim 3, wherein the hollow formation is of a material soft enough to be bitten into by the fins if an attempt is made to withdraw the tongue from the hollow formation.

5. The enclosure as claimed in claim 1, wherein the latch means comprises opposite saw-tooth formations on the frame and on the cover plate which, when mutually engaged, ensure that the cover plate can be slid relative to the frame only in one direction.

6. The enclosure as claimed in claim 5, wherein said saw-tooth formations are under the flanges of the frame and on said side edges of the cover plate.

7. The enclosure as claimed in claim 1 wherein said flexible material is an elasticated material.

8. The enclosure as claimed in claim 1, wherein the frame is adapted to be snap-fitted into the top of an open-topped container which is locatable in a housing, the container being held in the housing by a catch which is disengaged by the cover plate as the latter fully closes the frame.

9. The enclosure as claimed in claim 1, wherein there are hinged to parallel sides of the frame flaps biased to remain in a co-planar attitude, stop means being provided to prevent said flaps rising above the frame, said flaps being deflectable to allow passage of one or more bank notes to be bagged in the flexible material.

10. The enclosure as claimed in claim 9, wherein end edges of the flaps have protrusions which are forced past the adjacent end member of the frame as one or more bank notes are pushed through the frame, the protrusions engaging the underside of said end member to prevent the flaps rising from the frame when the pushing force is relieved.

11. A tamper-evident enclosure for the storage and transport of bank notes, the enclosure comprising a frame spanned by a flexible material, the frame having parallel sides provided with flanges under which side edges of a cover plate may be received, whereby the cover plate can be slid under the flanges to close the frame, a leading end of the cover plate being provided with a tongue which enters a correspondingly shaped, hollow formation at the leading end of the frame as the cover plate fully closes the frame and latch means to prevent withdrawal of the tongue from said hollow formation once received therein, wherein the tongue is breakable and said hollow formation can be bent down and wherein the arrangement is such that the cover plate can be removed by continued movement in the same direction once the tongue is broken and bent down with the hollow formation.

12. The enclosure as claimed in claim 11, wherein said flexible material is an elasticated material.

13. A tamper-evident enclosure for the storage and transport of bank notes, the enclosure comprising a frame spanned by a flexible material, the frame having parallel sides provided with flanges under which side edges of a cover plate may be received, whereby the cover plate can be slid under the flanges to close the frame, a leading end of the cover plate being provided with a tongue which enters a correspondingly shaped, hollow formation at the leading end of the frame as the cover plate fully closes the frame and latch means to prevent withdrawal of the tongue from said hollow formation once received therein, where the latch means comprises opposite saw-tooth formations on the frame and on the cover plate which, when mutually engaged, ensure that the cover plate can be slid relative to the frame only in one direction and wherein said saw-tooth formations are under the flanges of the frame and on said side edges of the cover plate.

14. The enclosure as claimed in claim 13, wherein said flexible material is an elasticated material.

15. A tamper-evident enclosure for the storage and transport of bank notes, the enclosure comprising a frame spanned by a flexible material, the frame having parallel sides provided with flanges under which side edges of a cover plate may be received, whereby the cover plate can be slid under the flanges to close the frame, a leading end of the cover plate being provided with a tongue which enters a correspondingly shaped, hollow formation at the leading end of the frame as the cover plate fully closes the frame and latch means to prevent withdrawal of the tongue from said hollow formation once received therein, wherein the frame is adapted to be snap-fitted into the top of an open-topped container which is locatable in a housing, the container being held in the housing by a catch which is disengaged by the cover plate as the latter fully closes the frame.

16. The enclosure as claimed in claim 15, wherein there are hinged to parallel sides of the frame flaps biased to remain in a co-planar attitude, stop means being provided to prevent said flaps rising above the frame, said flaps being deflectable to allow passage of one or more bank notes to be bagged in the flexible material.

17. The enclosure as claimed in claim 16, wherein end edges of the flaps have protrusions which are forced past the adjacent end member of the frame as one or more bank notes are pushed through the frame, the protrusions engaging the underside of said end member to prevent the flaps rising from the frame when the pushing force is relieved.

18. A tamper evident enclosure for transporting documents, comprising:

a frame having channels provided along longer parallel sides of the frame, the channels for receiving a cover plate, and a cover plate, wherein the frame is spanned by a flexible material which will form a bag to enclose a note or notes pressed through the frame, and wherein when the cover plate is fully received in the channels, an irreversible lock is formed between the cover plate and the frame, wherein the enclosure is adapted to be received in a container so as to be removable from the container only when the irreversible lock is formed between the cover plate and the frame.

19. An apparatus for the storage and transport of bank notes, comprising:

an enclosure, a tray being adapted to receive one or more bank notes but having a bottom opening and/or openable bottom, a plunger movable within the enclosure in a second direction generally perpendicular to the first direction to displace one or more bank notes upon the tray through the bottom of the tray and storage means removably positioned within the enclosure on the opposite side of the tray to the plunger to accept said note or notes when displaced through the bottom of the tray, wherein the storage means comprises a frame having channels to receive a cover plate along its longer parallel sides and wherein the frame is spanned by a flexible material for forming a bag to enclose a note or notes pressed into the storage means by the plunger.

20. The apparatus as claimed in claim 19, wherein the storage means is removable from the enclosure only when the cover plate is fully received in the channels and an irreversible lock is formed between the cover plate and the frame.

21. A tamper-evident enclosure for transporting documents comprising a frame having channels provided along longer parallel sides of the frame, the channels for receiving a cover plate, and a cover plate, wherein the frame is spanned by a flexible material which will form a bag to enclose a note or notes pressed through the frame, wherein when the cover plate is fully received in the channels, an irreversible lock is formed between the cover plate and the frame and wherein the frame is held within a container and is removable from the container only when the irreversible lock is formed between the cover plate and the frame.

* * * * *